US010389056B2

(12) United States Patent
Suzuki et al.

(10) Patent No.: US 10,389,056 B2
(45) Date of Patent: Aug. 20, 2019

(54) CONNECTOR

(71) Applicant: Yazaki Corporation, Tokyo (JP)

(72) Inventors: Takatoshi Suzuki, Shizuoka (JP); Tomokazu Iwami, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/882,943

(22) Filed: Jan. 29, 2018

(65) Prior Publication Data

US 2018/0219316 A1 Aug. 2, 2018

(30) Foreign Application Priority Data

Feb. 1, 2017 (JP) ..... 2017-016680

(51) Int. Cl.
*H01R 13/426* (2006.01)
*H01R 13/447* (2006.01)
*H01R 13/66* (2006.01)

(52) U.S. Cl.
CPC ..... *H01R 13/426* (2013.01); *H01R 13/447* (2013.01); *H01R 13/6683* (2013.01)

(58) Field of Classification Search
CPC ..... H01R 13/26; H01R 13/447; H01R 13/426
See application file for complete search history.

(56) References Cited

U.S. PATENT DOCUMENTS

| | | | | |
|---|---|---|---|---|
| 9,373,918 | B2 * | 6/2016 | Kawai | H01R 13/6683 |
| 2016/0111831 | A1 | 4/2016 | Kawai et al. | |
| 2016/0126681 | A1 | 5/2016 | Kawai et al. | |
| 2018/0048090 | A1 | 2/2018 | Kawai et al. | |

FOREIGN PATENT DOCUMENTS

| | | | |
|---|---|---|---|
| JP | 1-102663 | U1 | 7/1989 |
| JP | 11-118304 | A | 4/1999 |
| JP | 2015-8099 | A | 1/2015 |
| JP | 2015-11797 | A | 1/2015 |
| JP | 6023667 | B2 | 11/2016 |
| JP | 2018-26288 | A | 2/2018 |

OTHER PUBLICATIONS

Chinese Office Action for the related Chinese Patent Application No. 201810097192.0 dated Mar. 5, 2019.
Japanese Office Action for the related Japanese Patent Application No. 2017-016680 dated Feb. 19, 2019.

* cited by examiner

*Primary Examiner* — Briggitte R. Hammond
(74) *Attorney, Agent, or Firm* — Kenealy Vaidya LLP

(57) ABSTRACT

A connector includes a terminal, a connector housing, a temperature sensor, and a holder. The connector housing houses the terminal. The temperature sensor defines the terminal or an electric wire connected to the terminal as a temperature detection target, and detects temperature of the temperature detection target. The holder houses and holds the terminal, the electric wire, and the temperature sensor. The holder includes at least one first pressing portion and a second pressing portion. The first pressing portion projects toward the housed temperature sensor, and presses and pushes the temperature sensor to the temperature detection target. The second pressing portion presses and pushes the housed temperature detection target to the temperature sensor.

20 Claims, 15 Drawing Sheets

CONNECTOR

CROSS-REFERENCE TO RELATED APPLICATION(S)

The present application claims priority to and incorporates by reference the entire contents of Japanese Patent Application No. 2017-016680 filed in Japan on Feb. 1, 2017.

BACKGROUND OF THE INVENTION

1. Field of the Invention

The present invention relates to a connector.

2. Description of the Related Art

Conventionally, there has been known a connector that includes a temperature sensor. In this connector, temperature of a terminal and an electric wire connected to the terminal is detected or estimated by the temperature sensor, and a current value of a conducting current flowing into the terminal and the electric wire is controlled based on detected temperature of a temperature detection target or estimated temperature of a temperature estimation target estimated from the detected temperature. The conducting current control related to this connector depends on the temperature detected by the temperature sensor, and accuracy in detected temperature is reflected on accuracy in control. Thus, in this connector, it is desirable that the temperature sensor be closely attached to the temperature detection target in order to enhance accuracy in detected temperature. For example, this kind of connector is disclosed in Japanese Patent No. 6023667, and detects temperature of an electric wire as a temperature detection target using a temperature sensor. In this conventional connector, a holder holding an electric wire and a temperature sensor is formed of a plurality of holder members, and, by engaging the holder members with each other so that the electric wire and the temperature sensor are pressed to each other, accuracy in temperature detection of the electric wire using the temperature sensor can be enhanced.

When a temperature detection target and a temperature sensor are pressed to each other, the respective holder members are closely attached to the temperature detection target and the temperature sensor. However, in the temperature sensor, as a contact area with the holder member is larger, heat transferred from the temperature detection target easily escapes to the holder member and deviation of detected temperature against actual temperature of the temperature detection target becomes large. The conventional connector has a temperature sensor pressed to a temperature detection target (electric wire) on a wall surface and has room to improve accuracy in temperature detection of the temperature detection target.

SUMMARY OF THE INVENTION

An object of the present invention is to provide a connector capable of improving accuracy in temperature detection of a temperature detection target.

In order to achieve the above mentioned object, a connector according to one aspect of the present invention includes a terminal; a connector housing that houses the terminal; a temperature sensor that detects temperature of a temperature detection target, the temperature detection target being the terminal or an electric wire connected to the terminal; and a holder that houses and holds the terminal, the electric wire, and the temperature sensor, wherein the holder includes at least one first pressing portion that projects toward the housed temperature sensor, and presses and pushes the temperature sensor to the temperature detection target, and a second pressing portion that presses and pushes the housed temperature detection target to the temperature sensor.

According to another aspect of the present invention, in the connector, it is possible to configure that the first pressing portion is formed so as to be brought into point-contact or line-contact with the temperature sensor.

According to still another aspect of the present invention, in the connector, it is possible to configure that at least the one first pressing portion is disposed so as to press and push a temperature detecting portion of the temperature sensor to the temperature detection target.

According to still another aspect of the present invention, in the connector, it is possible to configure that the holder includes a first holder member that includes one of the first pressing portion and the second pressing portion, and a second holder member that includes the other of the first pressing portion and the second pressing portion, and is engaged with the first holder member so as to generate pressing force of the first pressing portion to the temperature sensor and pressing force of the second pressing portion to the temperature detection target.

According to still another aspect of the present invention, in the connector, it is possible to configure that the holder includes a holding structure at least at two positions, the holding structures holding the first holder member and the second holder member engaged with each other in an engagement state, each of the holding structures includes a first engagement holding portion that is provided to the first holder member, a second engagement holding portion that is provided to the second holder member and is engaged with the first engagement holding portion so as to keep the engagement state, and a flexible portion that includes one of the first engagement holding portion and the second engagement holding portion, and has flexibility of deflecting during engagement operation of the first holder member and the second holder member and eliminating deflection at completion of engagement between the first holder member and the second holder member, and the flexible portion in each of the holding structures is, when the first engagement holding portion in the holding structure sandwiches the second engagement holding portion in the holding structure, provided to the second holder member and includes the second engagement holding portion, and is, when the second engagement holding portion in the holding structure sandwiches the first engagement holding portion in the holding structure, provided to the first holder member and includes the first engagement holding portion.

According to still another aspect of the present invention, in the connector, it is possible to configure that when a plurality of the temperature detection targets are provided and the temperature sensor is provided for each of the temperature detection targets, the second holder member is provided for each combination of the temperature detection target and the temperature sensor.

According to still another aspect of the present invention, in the connector, it is possible to configure that the temperature detection target is the electric wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

An embodiment of a connector according to the present invention will now be described in detail with reference to the accompanying drawings. It should be noted that this embodiment is not intended to limit the invention.

Embodiment

One of the embodiments of the connector according to the present invention is described with reference to FIGS. 1 to 15.

Figure 1:
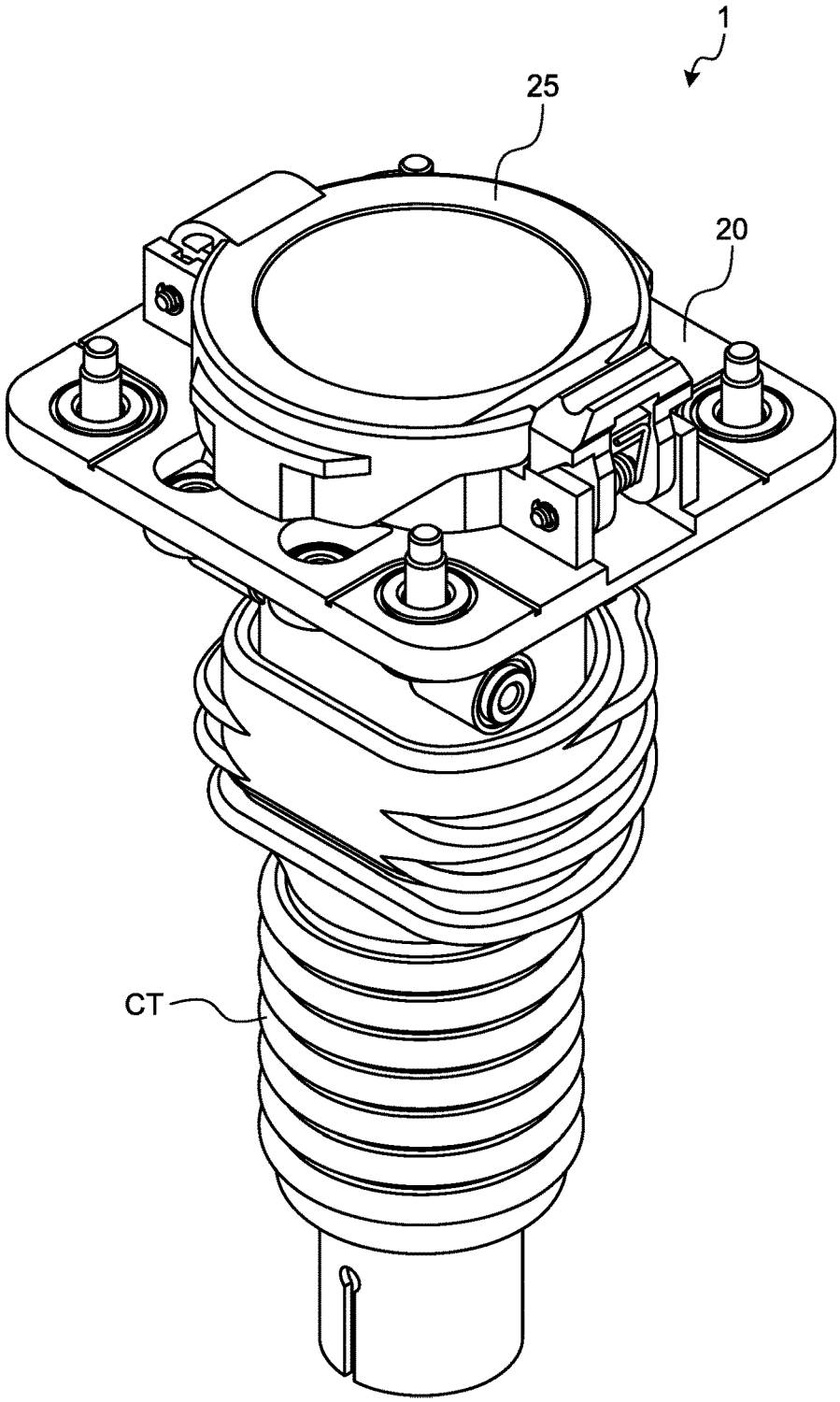
FIG. 1 is a perspective view illustrating a connector in accordance with an embodiment of the present invention and is a view illustrating a closing state of a lid member.
Figure 2:
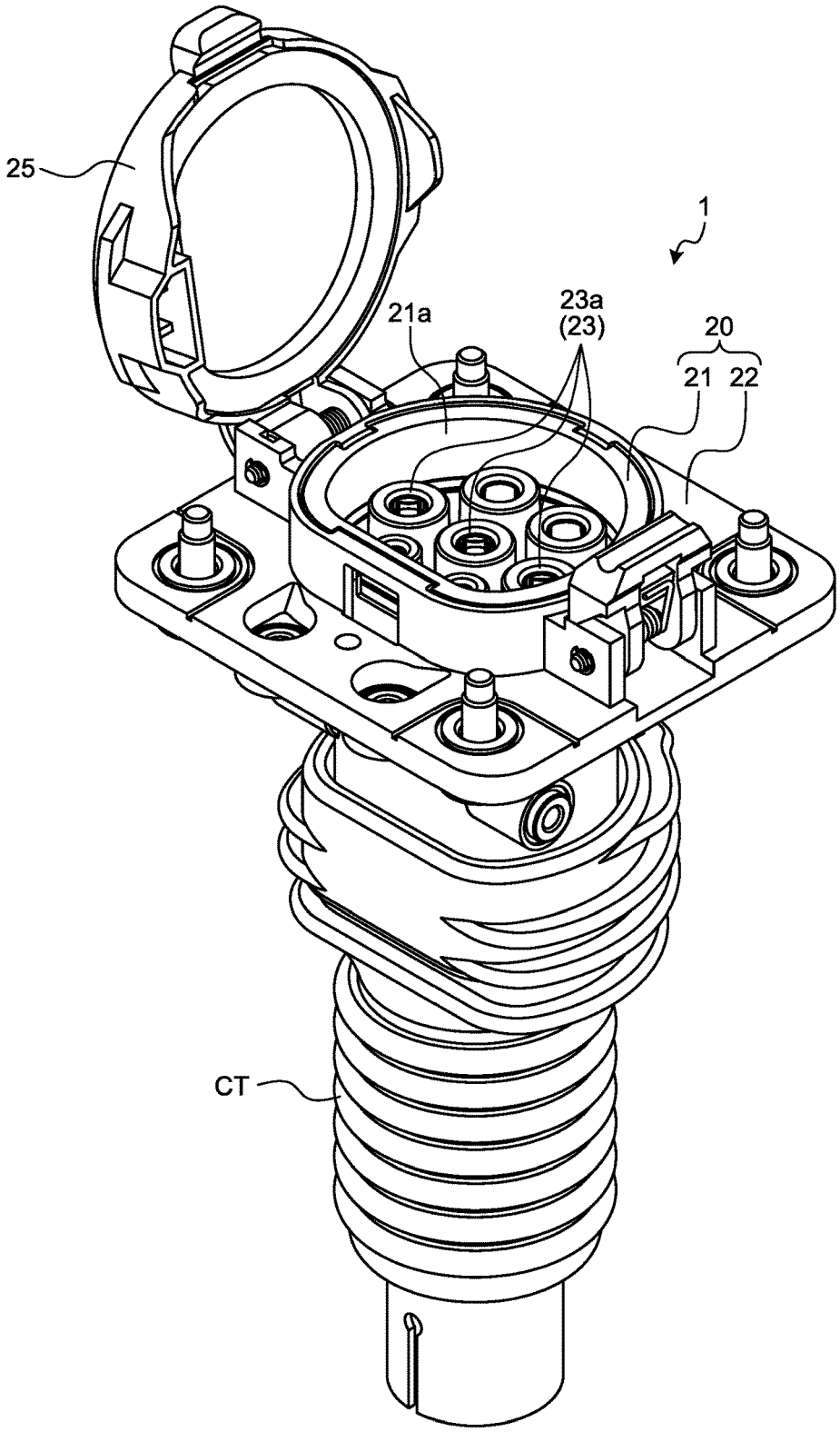
FIG. 2 is a perspective view illustrating the connector in accordance with the embodiment and is a view illustrating an open state of the lid member.
Figure 3:
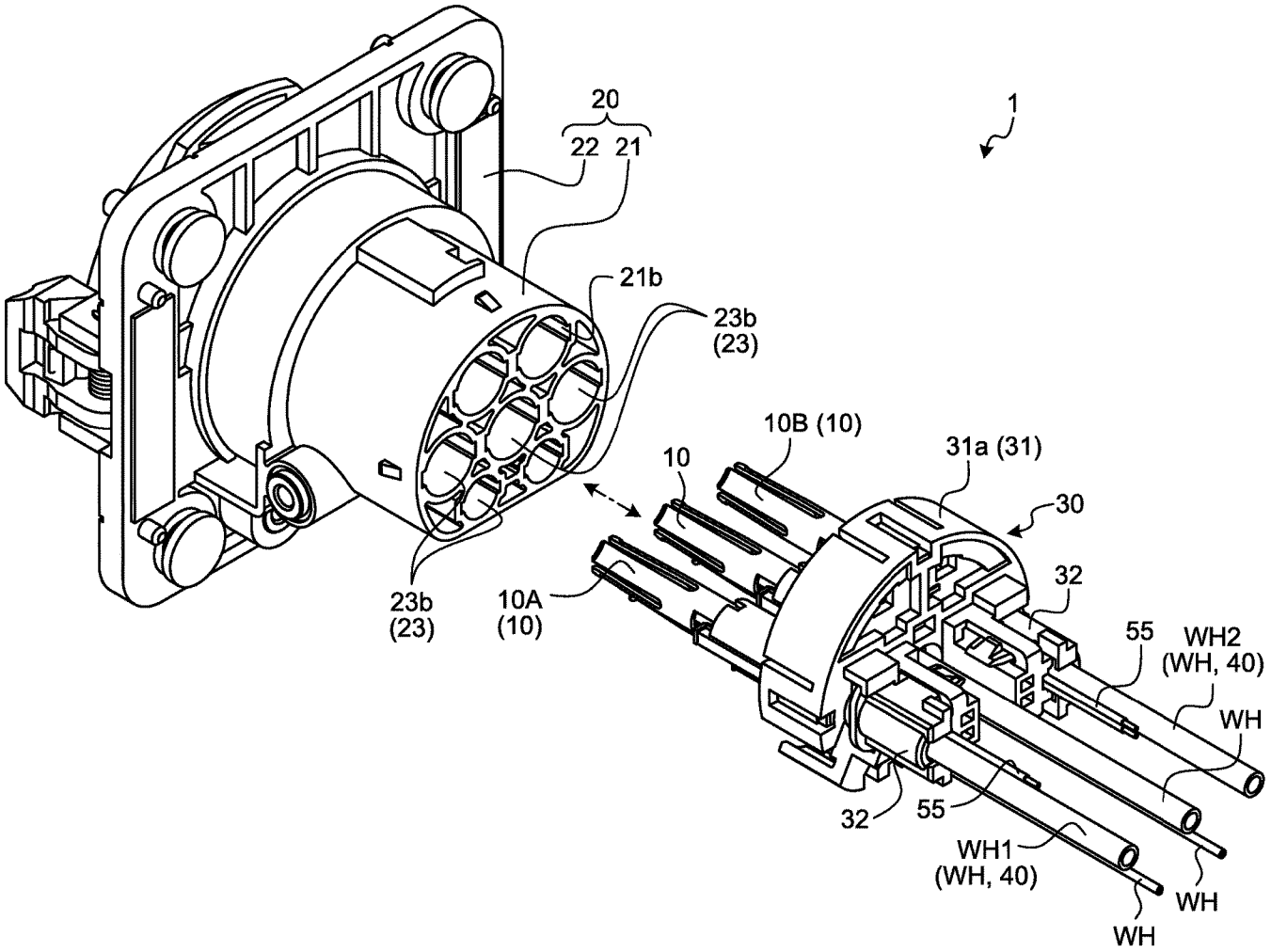
FIG. 3 is an exploded perspective view where a connector housing part and a holder part are separated.

A numeral 1 in FIGS. 1 to 3 indicates a connector of the embodiment. This exemplified connector 1 is a charge connector of a vehicle (electric vehicles, plug-in hybrid vehicles, and the like) in which an electric motor is provided as a power source, and is used for charging a secondary battery responsible for power feeding to the electric motor. In this kind of vehicle, a counterpart connector (not illustrated) provided to a charger is inserted into the connector 1, and a secondary battery is charged by power feeding from the charger.

Figure 4:
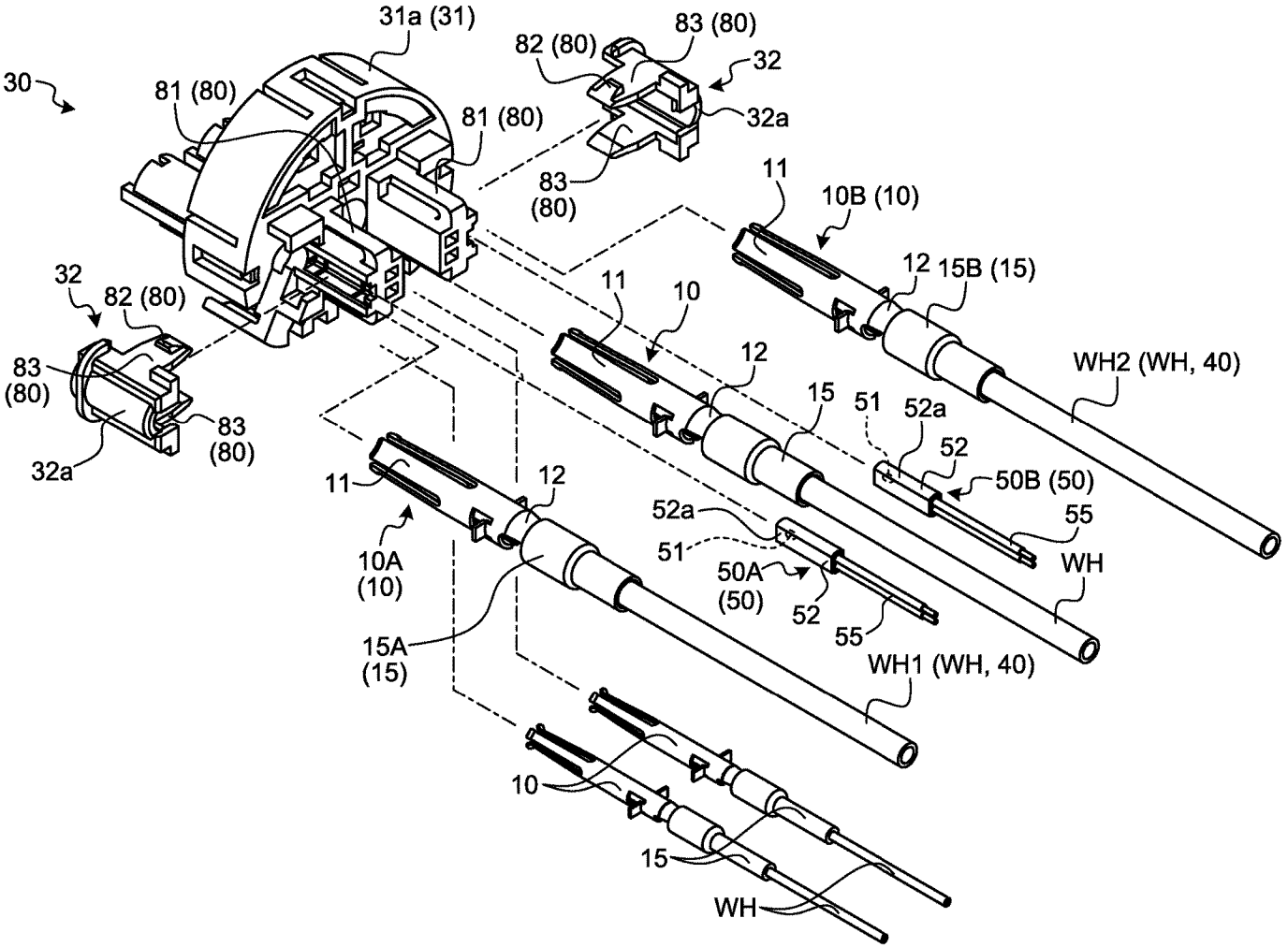
FIG. 4 is an exploded perspective view illustrating the holder part.

The connector 1 includes a terminal 10, a connector housing 20 that houses the terminal 10, and a holder 30 that houses and holds the terminal 10 and an electric wire WH connected to the terminal 10 (FIG. 3). The electric wire WH is drawn outward from the connector 1, and is covered with a protection member CT (FIG. 1) together with a wire lead-out unit in the connector 1. In addition, the connector 1 defines the terminal 10 or the electric wire WH as a temperature detection target 40, and includes a temperature sensor 50 that detects temperature of the temperature detection target 40. The holder 30 also houses and holds the temperature sensor 50 (FIG. 4). In this example, the electric wire WH is defined as the temperature detection target 40.

The terminal 10 is a male terminal or a female terminal that is formed of a conductive material such as metal, and includes a terminal connecting portion 11 and an electric wire connecting portion 12 (FIG. 4). This exemplified terminal 10 is a male terminal, and the terminal connecting portion 11 is formed as a male type. The terminal connecting portion 11 is a part that is physically and electrically connected to a counterpart terminal (not illustrated) of the counterpart connector. The electric wire connecting portion 12 is a part on which the end of the electric wire WH is, for example, press-bonded, and has an exposed core wire at the end of the electric wire WH physically and electrically connected thereto. The electric wire connecting portion 12 is covered with a cylindrical protection member 15 together with a cover at the end of the electric wire WH. The protection member 15 is, for example, a heat shrinkable tube, and prevents liquid such as water from entering the core wire at the end of the electric wire WH.

The connector 1 includes five terminals 10, and each of the terminals 10 is provided with the electric wire WH and the protection member 15. The connector 1 detects, out of five sets of combinations of the terminals 10, the electric wires WH, and the protection members 15, temperature of the two sets. Hereinafter, out of the two sets, the one terminal 10, electric wire WH, and protection member 15 may be referred to as a first terminal 10A, a first electric wire WH1, and a first protection member 15A, respectively. Out of the two sets, the other terminal 10, electric wire WH, and protection member 15 may be referred to as a second terminal 10B, a second electric wire WH2, and a second protection member 15B, respectively. Hereinafter, the temperature sensor 50 for detecting temperature of the first electric wire WH1 as the temperature detection target 40 may be referred to as a first temperature sensor 50A, and the temperature sensor 50 for detecting temperature of the second electric wire WH2 as the temperature detection target 40 may be referred to as a second temperature sensor 50B.

The connector housing 20 is formed of an insulating material such as a synthetic resin. This exemplified connector housing 20 includes a cylindrical main body 21 that has both ends in a cylindrical axis direction open, and a rectangular and plate-like flange 22 that covers a part of the outer peripheral edge of the main body 21 in the cylindrical axis direction (FIGS. 1 to 3). The connector housing 20 is disposed in a vehicle so that one aperture 21*a* (FIG. 2) of the main body 21 can be exposed to the outside of the vehicle, and is fixed to the vehicle through the flange 22 by a screw clamp and the like.

Inside the main body 21, a terminal housing chamber 23 is formed for each terminal 10 (FIGS. 2 and 3). Each of the terminal housing chambers 23 is a through-hole elongating along the cylindrical axis direction of the main body 21. In the terminal housing chamber 23, insertion and removal between the terminal 10 and the counterpart terminal are performed along the cylindrical axis direction. Each of the counterpart terminals is inserted from one aperture 23*a* (FIG. 2) into the inside of the terminal housing chamber 23. By contrast, each of the terminals 10 is inserted from the other aperture 23*b* (FIG. 3) into the inside of the terminal housing chamber 23.

The connector housing 20 has a lid member 25 attached thereto (FIGS. 1 and 2). The lid member 25 is a member that closes the one aperture 21*a* in the main body 21, and is openably and closably attached to the aperture 21*a*.

Figure 5:
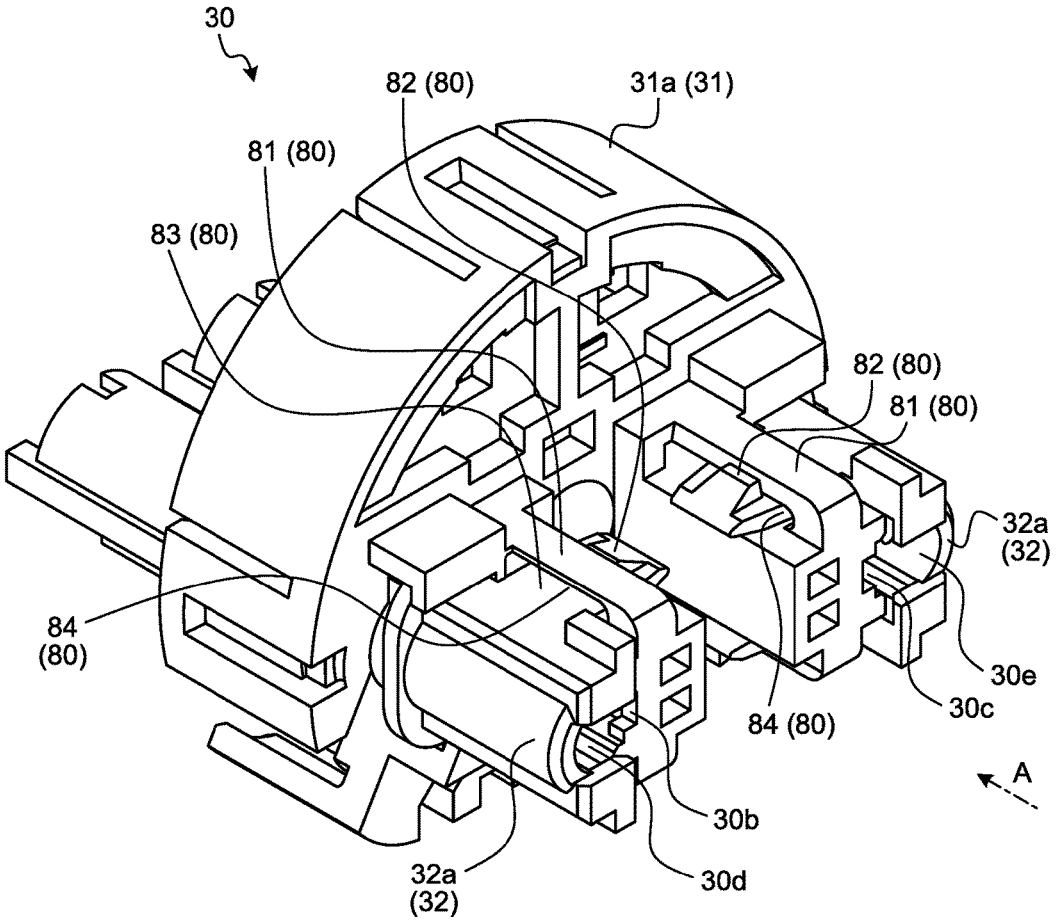
FIG. 5 is a perspective view illustrating a holder.
Figure 6:
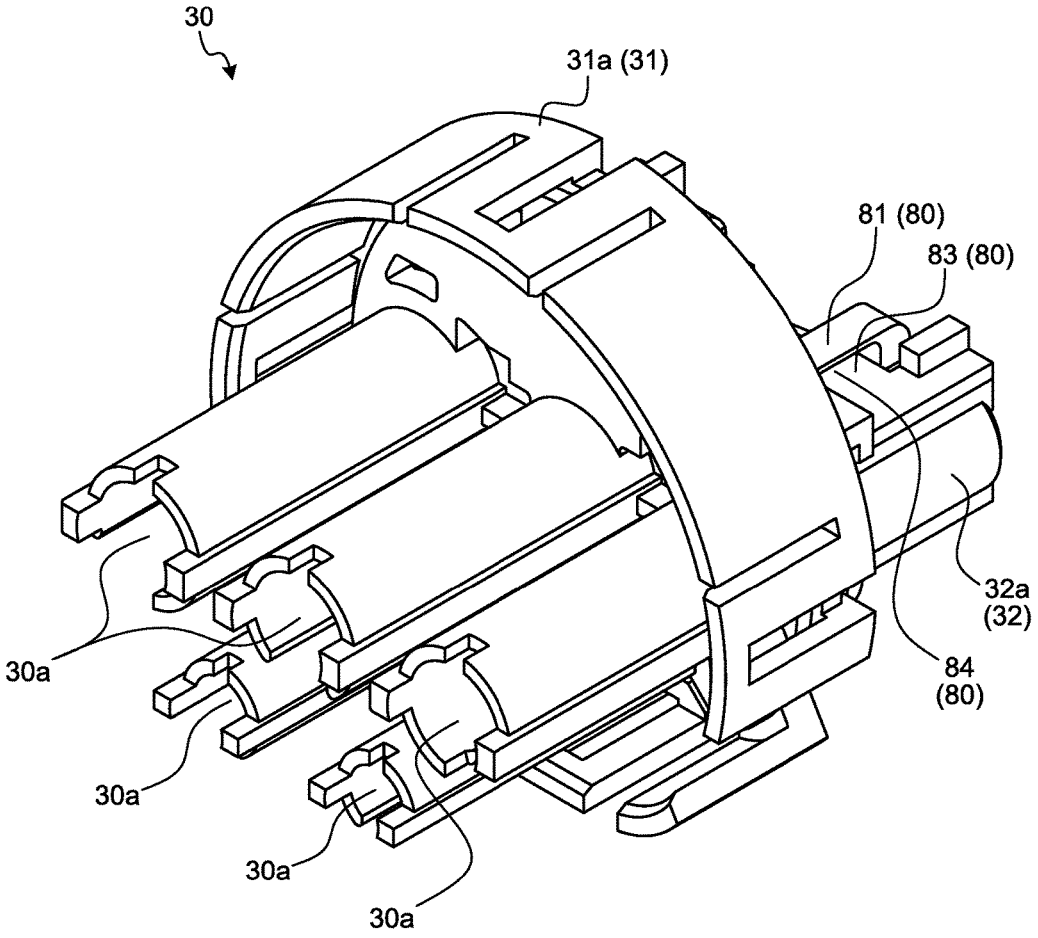
FIG. 6 is a perspective view illustrating the holder viewed from another angle.
Figure 7:
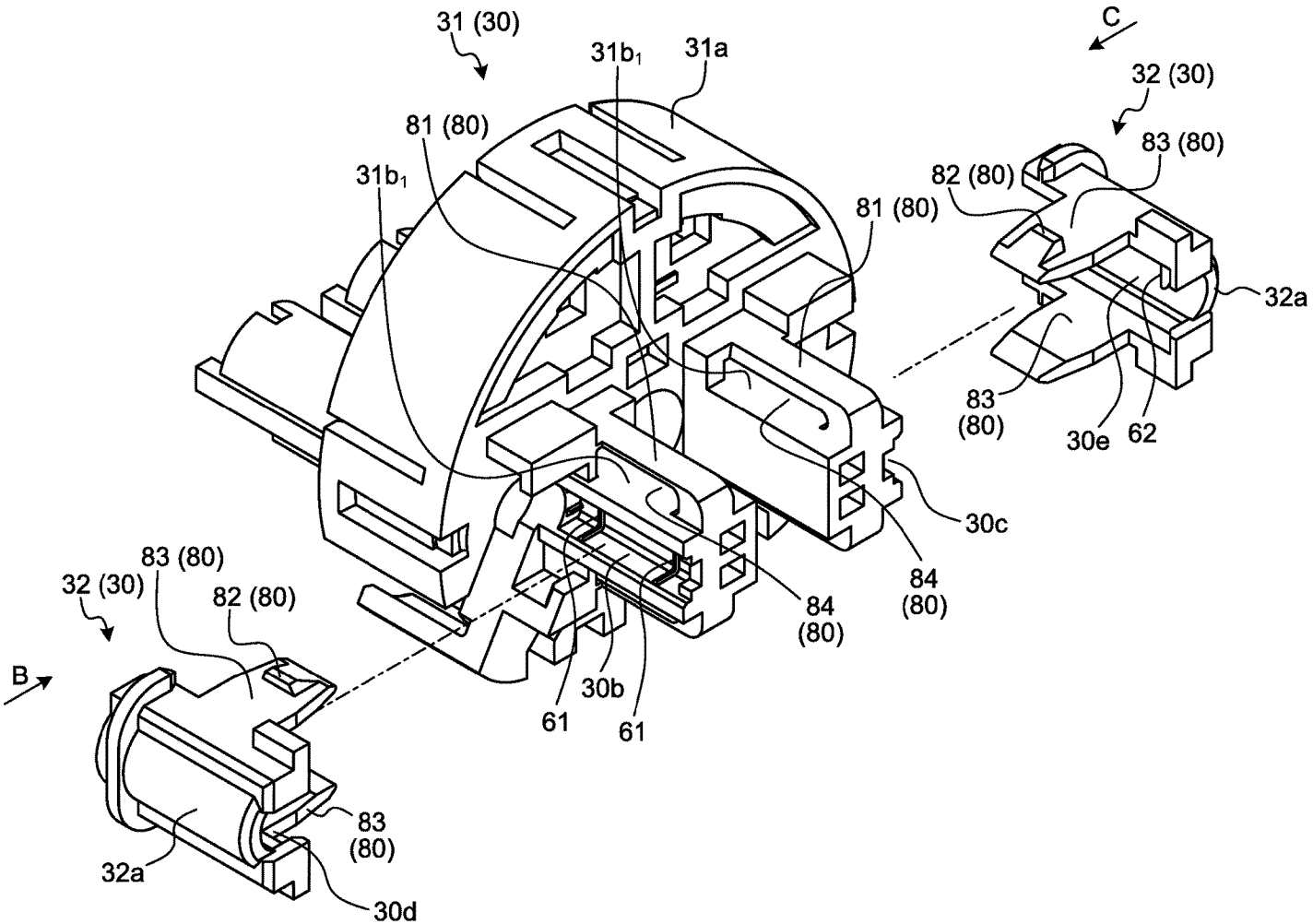
FIG. 7 is an exploded perspective view illustrating the holder.
Figure 8:
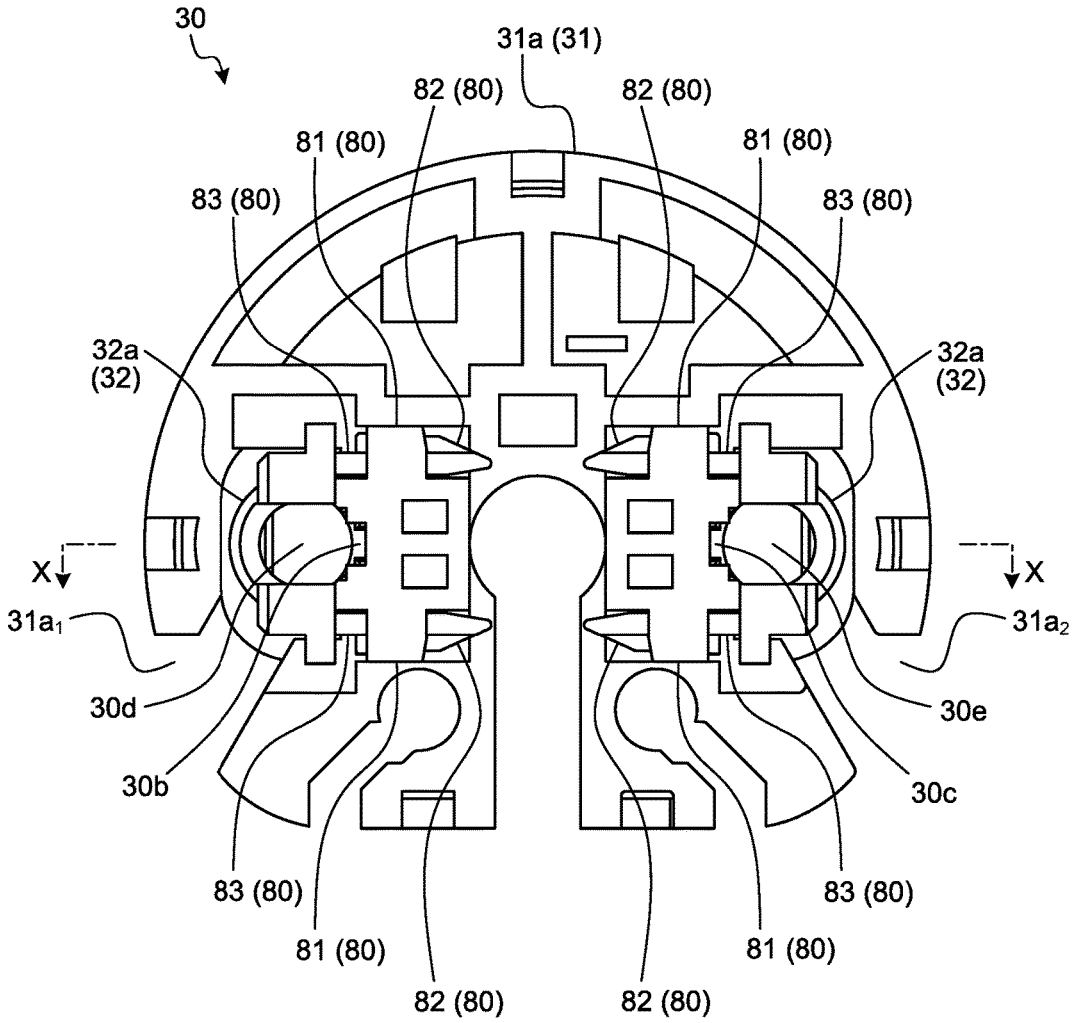
FIG. 8 is a plan view illustrating the holder viewed from the arrow direction A in FIG. 5.
Figure 9:
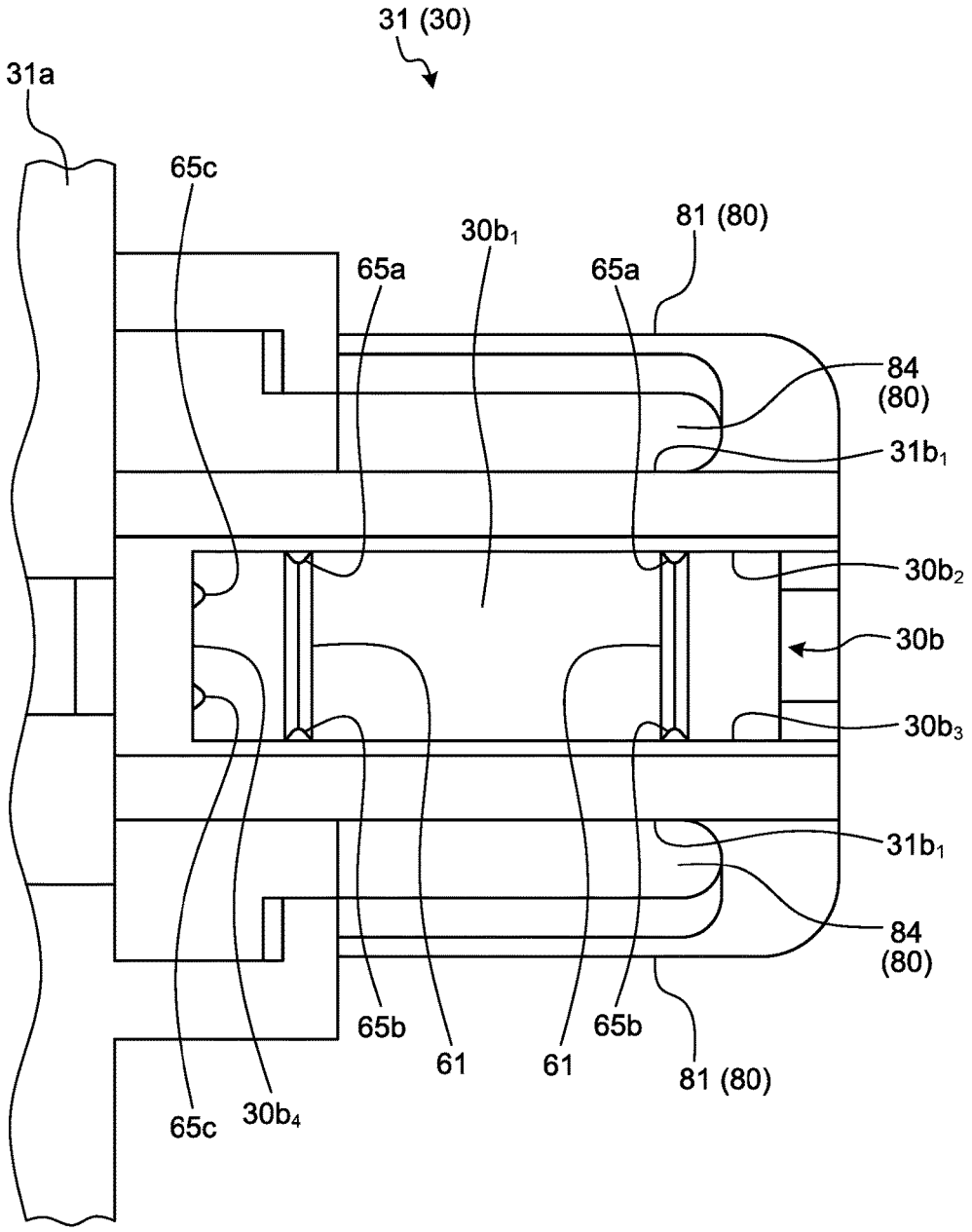
FIG. 9 is a plan view illustrating a first holder member viewed from the arrow direction B in FIG. 7, and is an enlarged view illustrating the periphery of a first sensor housing chamber.
Figure 10:
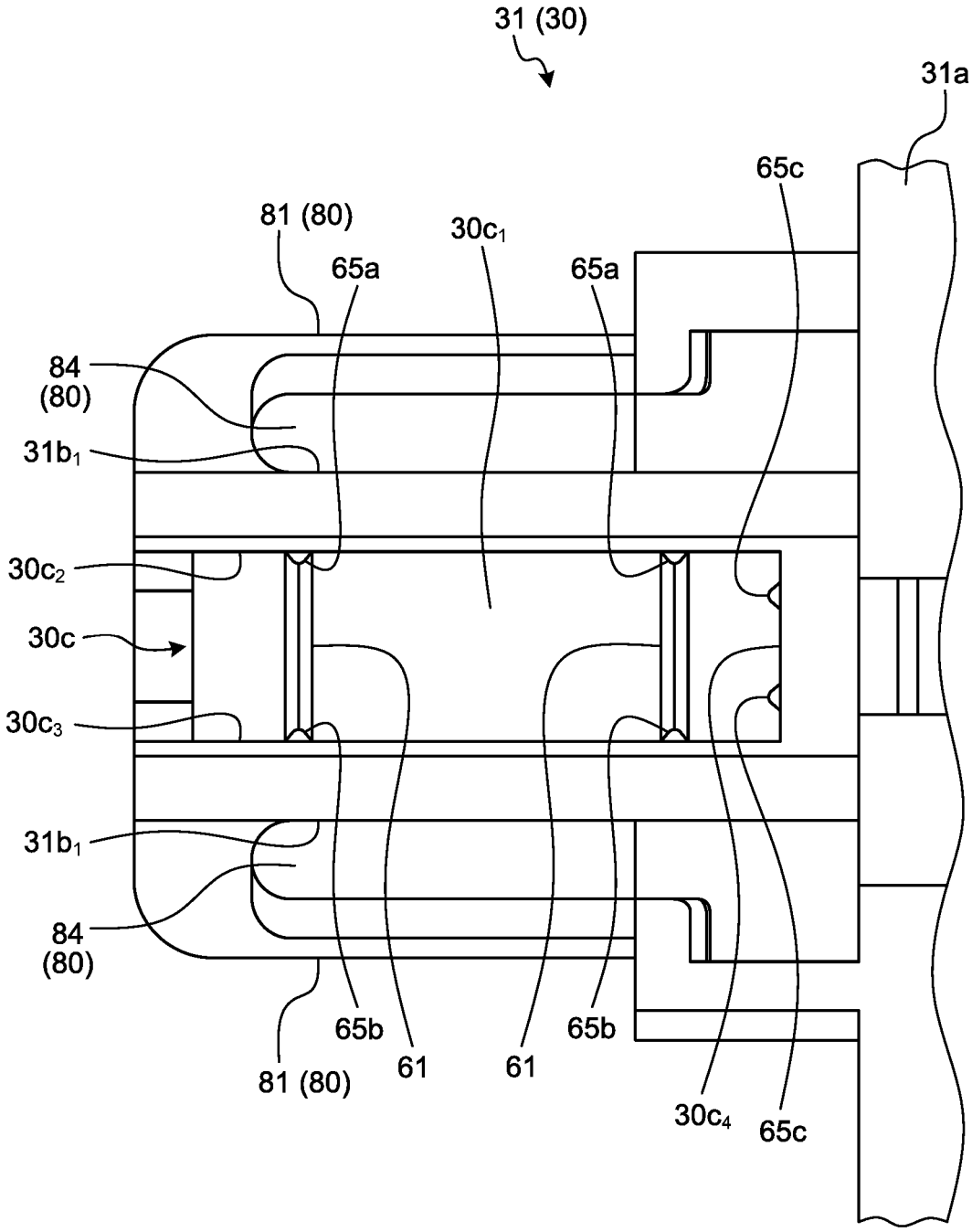
FIG. 10 is a plan view illustrating the first holder member viewed from the arrow direction C in FIG. 7, and is an enlarged view illustrating the periphery of a second sensor housing chamber.

The holder 30 is formed of an insulating material such as a synthetic resin. FIGS. 5 to 8 illustrate this exemplified holder 30. The holder 30 includes a terminal housing chamber 30*a* that houses and holds each of the terminals 10 (FIG. 6). The terminal housing chamber 30*a* is formed for each terminal 10. The holder 30 also includes a first sensor housing chamber 30*b* that houses and holds the first temperature sensor 50A, and a second sensor housing chamber 30*c* that houses and holds the second temperature sensor 50B (FIGS. 5 and 8). In addition, the holder 30 includes a first electric wire housing chamber 30*d* that houses and holds the first electric wire WH1, and a second electric wire housing chamber 30*e* that houses and holds the second electric wire WH2 (FIGS. 5 and 8).

In this exemplified connector 1, the first temperature sensor 50A detects temperature of the first electric wire WH1, and the second temperature sensor 50B detects temperature of the second electric wire WH2. Thus, the first sensor housing chamber 30*b* and the first electric wire housing chamber 30*d* are made adjacent to each other, and the second sensor housing chamber 30*c* and the second electric wire housing chamber 30*e* are made adjacent to each other. The first sensor housing chamber 30*b* and the first electric wire housing chamber 30*d* are formed so that the first temperature sensor 50A and the first electric wire WH1 are closely attached to each other. The second sensor housing chamber 30*c* and the second electric wire housing chamber 30*e* are formed so that the second temperature sensor 50B and the second electric wire WH2 are closely attached to each other.

The holder 30 includes at least one first pressing portion 61 that projects toward the housed temperature sensor 50, and presses and pushes the temperature sensor 50 on the temperature detection target 40, and a second pressing portion 62 that presses and pushes the housed temperature detection target 40 on the temperature sensor 50 (FIGS. 12 to 15).

At least the one first pressing portion 61 is provided to both the first sensor housing chamber 30*b* and the second sensor housing chamber 30*c*. The two first pressing portions 61 of the first sensor housing chamber 30*b* are provided at intervals from each other in the axis direction of the first electric wire WH1 housed in the first electric wire housing chamber 30*d*. The first pressing portions 61 of the first sensor housing chamber 30*b* project from a first wall surface $30b_1$ of the first sensor housing chamber 30*b* toward the housed first temperature sensor 50A (FIGS. 9, 12, and 13), and press and push the first temperature sensor 50A on the first electric wire WH1 as the temperature detection target 40. The two first pressing portions 61 of the second sensor housing chamber 30*c* are provided at intervals from each other in the axis direction of the second electric wire WH2 housed in the second electric wire housing chamber 30*e*. The first pressing portions 61 of the second sensor housing chamber 30*c* project from a first wall surface $30c_1$ of the second sensor housing chamber 30*c* toward the housed second temperature sensor 50B (FIGS. 10, 14, and 15), and press and push the second temperature sensor 50B on the second electric wire WH2 as the temperature detection target 40.

Figure 13:
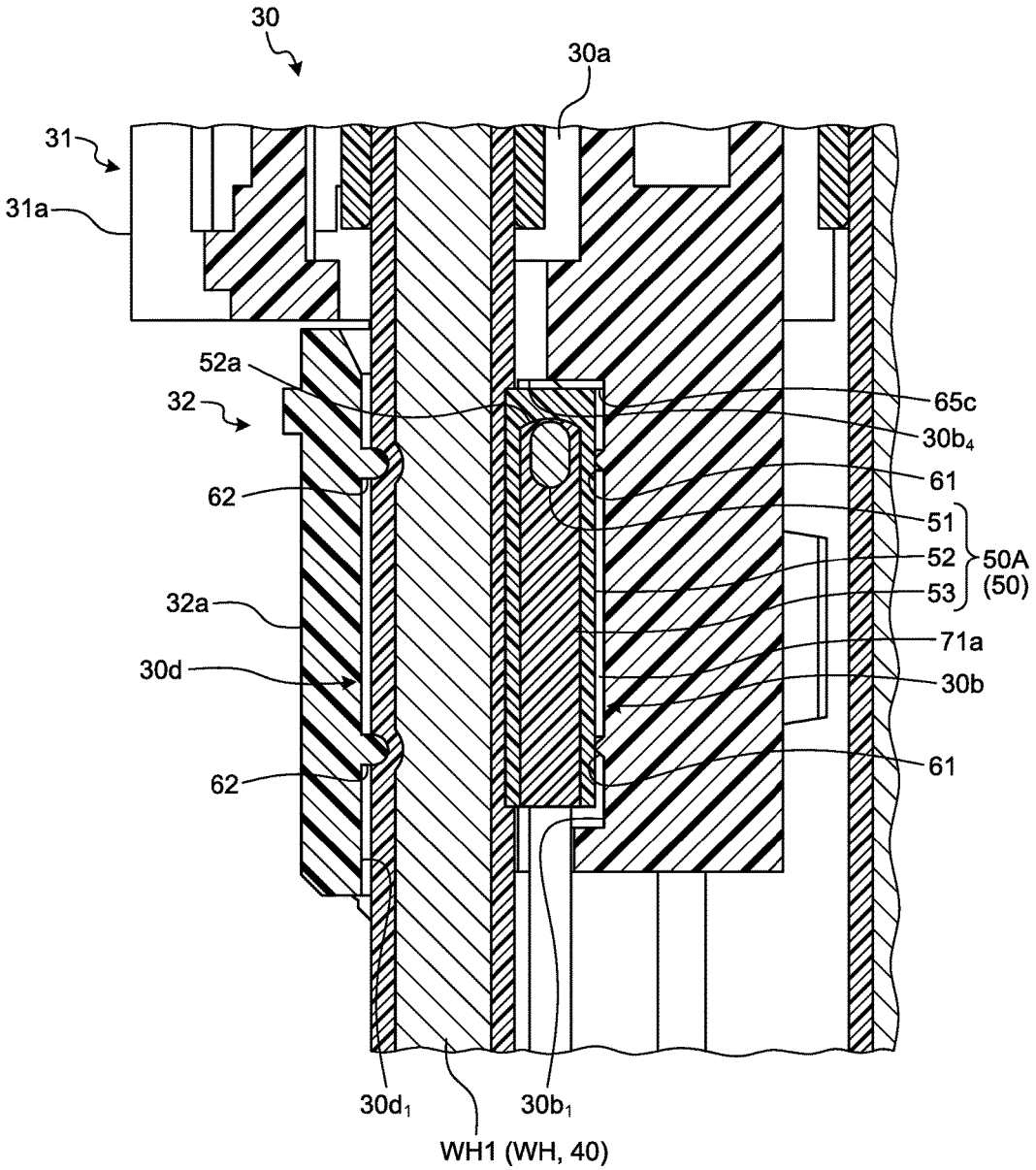
FIG. 13 is a cross-sectional view illustrating the cross-sectional view in FIG. 12 together with a temperature sensor and an electric wire.
Figure 14:
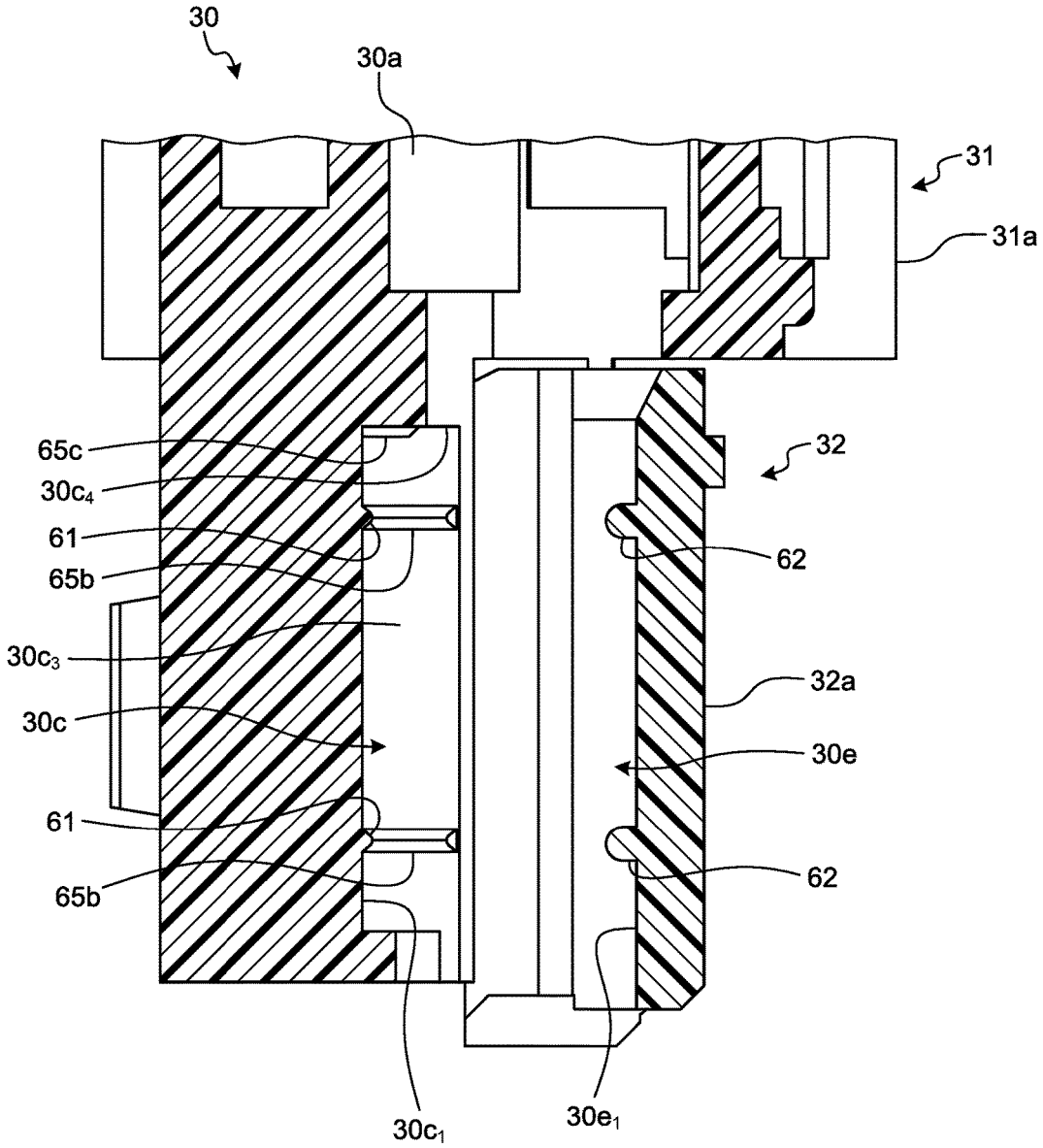
FIG. 14 is a cross-sectional view along line X-X in FIG. 8, and an enlarged view illustrating the periphery of the second sensor housing chamber.

The first pressing portions 61 of the first sensor housing chamber 30*b* are formed as projecting portions that project toward the first temperature sensor 50A, and can form an air layer 71*a* between the first temperature sensor 50A and the first wall surface $30b_1$ of the first sensor housing chamber 30*b* (FIG. 13). In the first sensor housing chamber 30*b*, the first temperature sensor 50A is not brought into contact with the first wall surface $30b_1$, and a contact area of the first temperature sensor 50A with a first wall surface $30b_1$ becomes small, thereby reducing a heat transfer amount for heat of the first temperature sensor 50A to the first wall surface $30b_1$. Thus, the connector 1 can improve accuracy in temperature detection of the first electric wire WH1 using the first temperature sensor 50A. In order to reduce a heat transfer amount from the first temperature sensor 50A to the first wall surface $30b_1$, it is desirable that the first pressing portions 61 of the first sensor housing chamber 30*b* be formed so as to be brought into point-contact or line-contact with the first temperature sensor 50A. In this example, each of the first pressing portions 61 has a cross section orthogonal to an elongation direction formed into a mountain shape, and is brought into line-contact where a peak of the mountain shape is pushed on the first temperature sensor 50A.

In this exemplified first sensor housing chamber 30*b*, the first temperature sensor 50A is disposed to face second to fourth wall surfaces $30b_2$ to $30b_4$ (FIG. 9) other than the first wall surface $30b_1$. Thus, for the first temperature sensor 50A, it is desirable that a contact area with each of the second to fourth wall surfaces $30b_2$ to $30b_4$ be made small. In the first sensor housing chamber 30*b*, at least one projecting portion (first to third projecting portions 65*a* to 65*c*) that projects toward the first temperature sensor 50A is provided on the second to fourth wall surfaces $30b_2$ to $30b_4$. In this manner, in the first sensor housing chamber 30*b*, an air layer, which will not be illustrated, can be also formed between the first temperature sensor 50A and the second wall surface $30b_2$, between the first temperature sensor 50A and the third wall surface $30b_3$, and the first temperature sensor 50A and the fourth wall surface $30b_4$. In the first sensor housing chamber 30*b*, the first temperature sensor 50A is not brought into contact with the second to fourth wall surfaces $30b_2$ to $30b_4$, and a contact area of the first temperature sensor 50A with each of the second to fourth wall surfaces $30b_2$ to $30b_4$ becomes small, thereby reducing a heat transfer amount for heat of the first temperature sensor 50A to the second to fourth wall surfaces $30b_2$ to $30b_4$. Thus, the connector 1 can further improve accuracy in temperature detection of the first electric wire WH1 using the first temperature sensor 50A. It is desirable that these first to third projecting portions 65*a* to 65*c* be formed so as to be brought into point-contact or line-contact with the first temperature sensor 50A.

Figure 15:
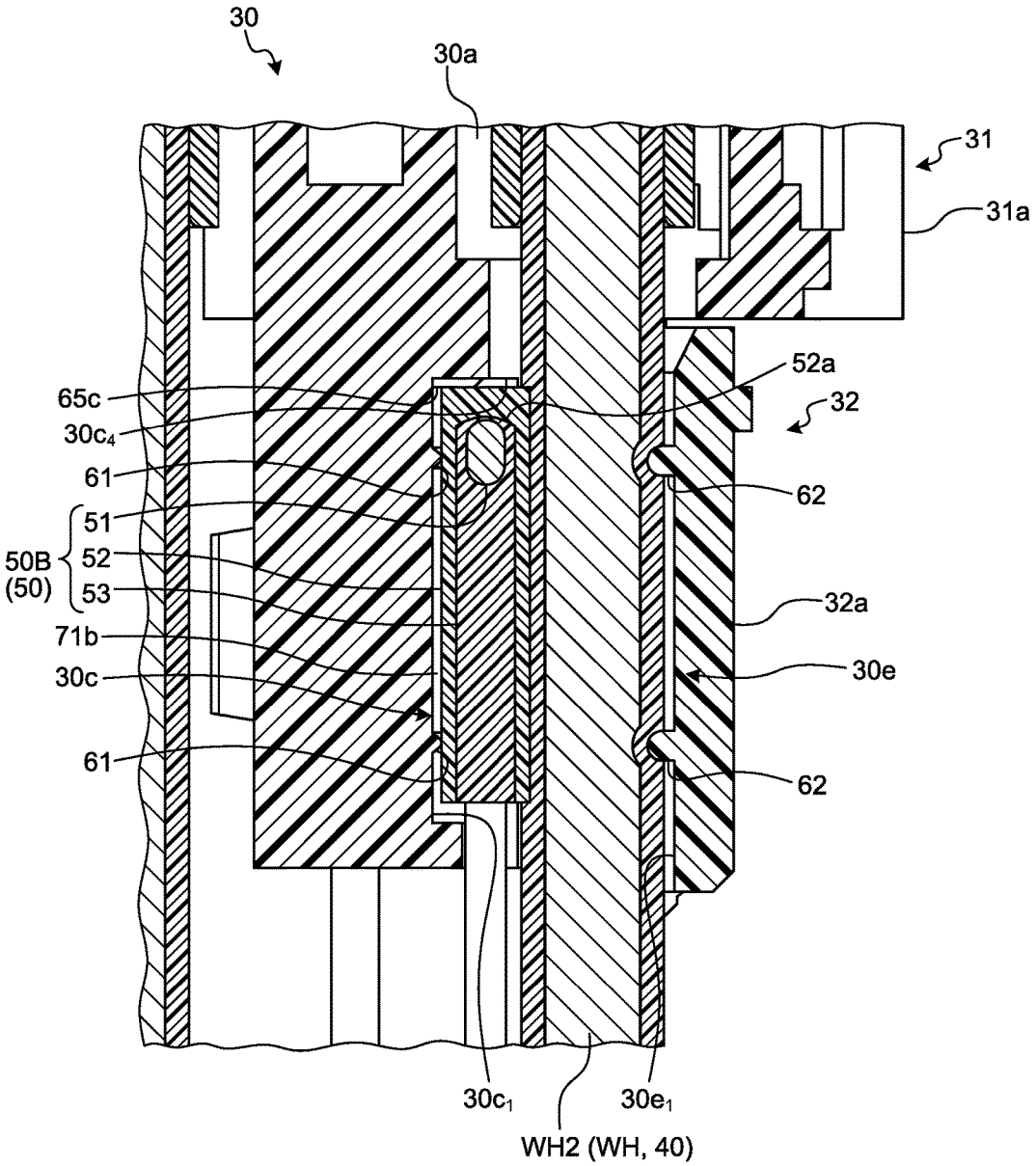
FIG. 15 is a cross-sectional view illustrating the cross-sectional view in FIG. 14 together with the temperature sensor and the electric wire.

The first pressing portions 61 of the second sensor housing chamber 30*c* are formed as projecting portions that project toward the second temperature sensor 50B, and can form, similarly to the first sensor housing chamber 30*b*, an air layer 71*b* between the second temperature sensor 50B and the first wall surface $30c_1$ of the second sensor housing chamber 30*c* (FIG. 15). Similarly to the first sensor housing chamber 30*b*, in the second sensor housing chamber 30*c*, a heat transfer amount for heat of the second temperature sensor 50B to the first wall surface 30$c_1$ can be reduced. Thus, the connector 1 can improve accuracy in temperature detection of the second electric wire WH2 using the second temperature sensor 50B. In order to reduce a heat transfer amount from the second temperature sensor 50B to the first wall surface 30$c_1$, it is desirable that the first pressing portions 61 of the second sensor housing chamber 30*c* be formed so as to be brought into point-contact or line-contact with the second temperature sensor 50B. In this example, each of the first pressing portions 61 has a cross section orthogonal to an elongation direction formed into a mountain shape, and a peak of the mountain shape is pushed on the second temperature sensor 50B so as to be brought into line-contact.

Similarly to the first sensor housing chamber 30*b*, in this exemplified second sensor housing chamber 30*c*, the second temperature sensor 50B is disposed to face second to fourth wall surfaces 30$c_2$ to 30$c_4$ (FIG. 10) other than the first wall surface 30$c_1$. Thus, similarly to the first sensor housing chamber 30*b*, in the second sensor housing chamber 30*c*, at least one projecting portion (first to third projecting portions 65*a* to 65*c*) that projects toward the second temperature sensor 50B is provided on the second to fourth wall surfaces 30$c_2$ to 30$c_4$, and an air layer can be formed therebetween. Similarly to the first sensor housing chamber 30*b*, in the second sensor housing chamber 30*c*, a heat transfer amount for heat of the second temperature sensor 50B to the second to fourth wall surfaces 30$c_2$ to 30$c_4$ can be reduced. Thus, the connector 1 can further improve accuracy in temperature detection of the second electric wire WH2 using the second temperature sensor 50B. Similarly to the first sensor housing chamber 30*b*, it is desirable that these first to third projecting portions 65*a* to 65*c* be formed so as to be brought into point-contact or line-contact with the second temperature sensor 50B.

Each of the temperature sensors 50 (the first temperature sensor 50A and the second temperature sensor 50B) includes a temperature detection device 51 that detects temperature of the corresponding electric wire WH (the first electric wire WH1 and the second electric wire WH2), and a cylindrical body 52 that has one end open and has the temperature detection device 51 inserted therein through the open end (FIGS. 4, 13, and 15). For example, in the temperature sensor 50, the inside of the cylindrical body 52 is filled with a liquid potting agent 53 (FIGS. 13 and 15), and the inward temperature detection device 51 is fixed to the cylindrical body 52 as the potting agent 53 is hardened. In this manner, in the temperature sensor 50, the temperature detection device 51 is disposed inside the cylindrical body 52 without any space, and the periphery of the temperature detection device 51 in the cylindrical body 52 serves as a temperature detecting portion 52*a* suitable for temperature detection. Thus, in the temperature sensor 50, it is desirable that at least the temperature detecting portion 52*a* be closely attached to the electric wire WH in order to enhance accuracy in temperature detection of the electric wire WH. In the first sensor housing chamber 30*b*, at least one of the two first pressing portions 61 is disposed so as to press and push the temperature detecting portion 52*a* of the first temperature sensor 50A to the first electric wire WH1 as the temperature detection target 40. In the second sensor housing chamber 30*c*, at least one of the two first pressing portions 61 is disposed so as to press and push the temperature detecting portion 52*a* of the second temperature sensor 50B to the second electric wire WH2 as the temperature detection target 40. Thus, the connector 1 can further improve, in each of the temperature sensors 50 (the first temperature sensor 50A and the second temperature sensor 50B), accuracy in temperature detection of the corresponding electric wire WH (the first electric wire WH1 and the second electric wire WH2).

Each of the temperature sensors 50 has an electric wire 55 connected thereto, which transmits a detection signal detected by the temperature detection device 51 to an electronic control device (not illustrated) and the like and causes the electronic control device to control a conducting current of the connector 1. Thus, the end of the electric wire 55 is housed inside the cylindrical body 52 while connected to the temperature detection device 51, and is fixed to the cylindrical body 52 with the potting agent 53.

The second pressing portion 62 is provided to both the first electric wire housing chamber 30*d* and the second electric wire housing chamber 30*e*. As the second pressing portion 62A, a wall surface of the first electric wire housing chamber 30*d* and a wall surface of the second electric wire housing chamber 30*e* may be used. In this case, the wall surface of the first electric wire housing chamber 30*d* can be closely attached to the first electric wire WH1, and the wall surface of the second electric wire housing chamber 30*e* can be closely attached to the second electric wire WH2, thereby allowing heat of the first electric wire WH1 to escape to the wall surface of the first electric wire housing chamber 30*d* and heat of the second electric wire WH2 to escape to the wall surface of the second electric wire housing chamber 30*e*. Thus, in this case, an increase in temperature of the electric wires WH (the first electric wire WH1 and the second electric wire WH2) can be reduced, and the durability of the terminals 10 (the first terminal 10A and the second terminal 10B) and the protection members 15 (the first protection member 15A and the second protection member 15B) as well as the electric wires WH can be improved.

Figure 11:
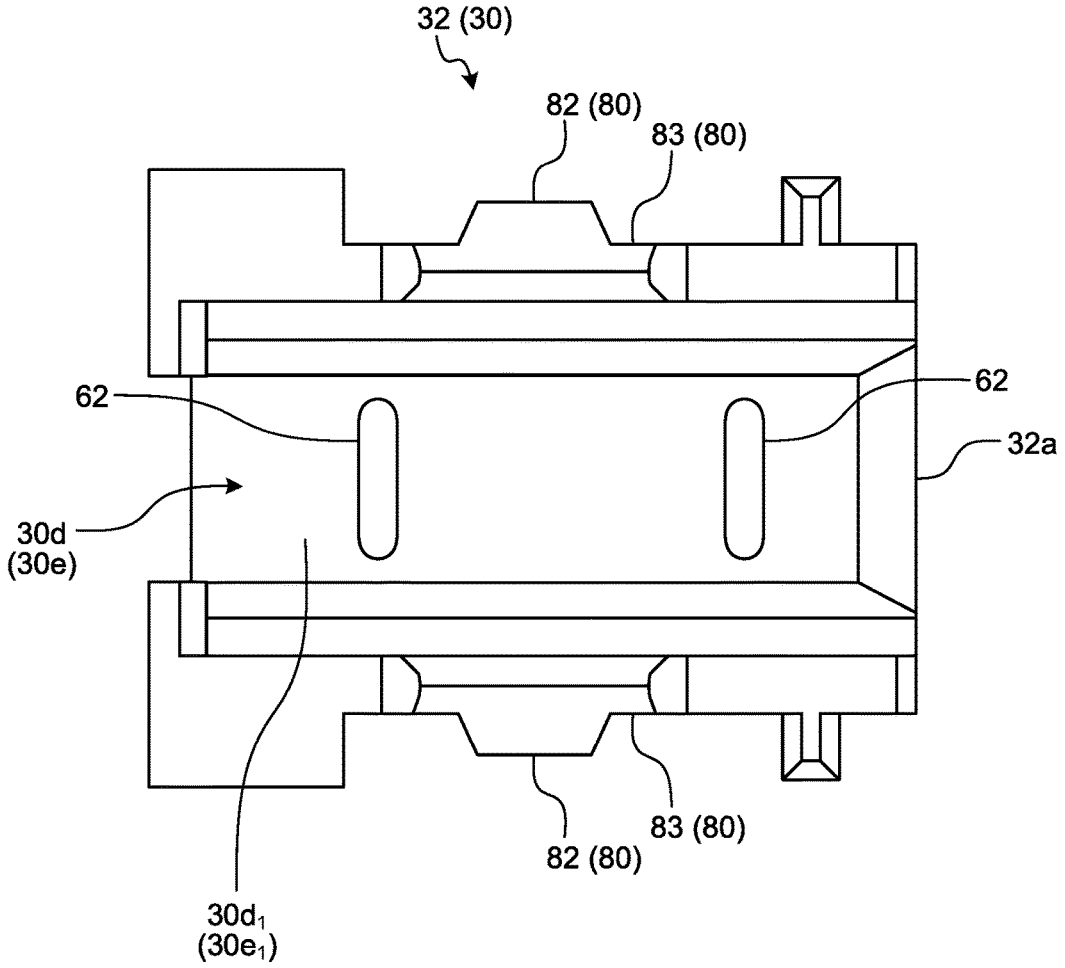
FIG. 11 is a plan view illustrating a second holder member viewed from an inner periphery side.
Figure 12:
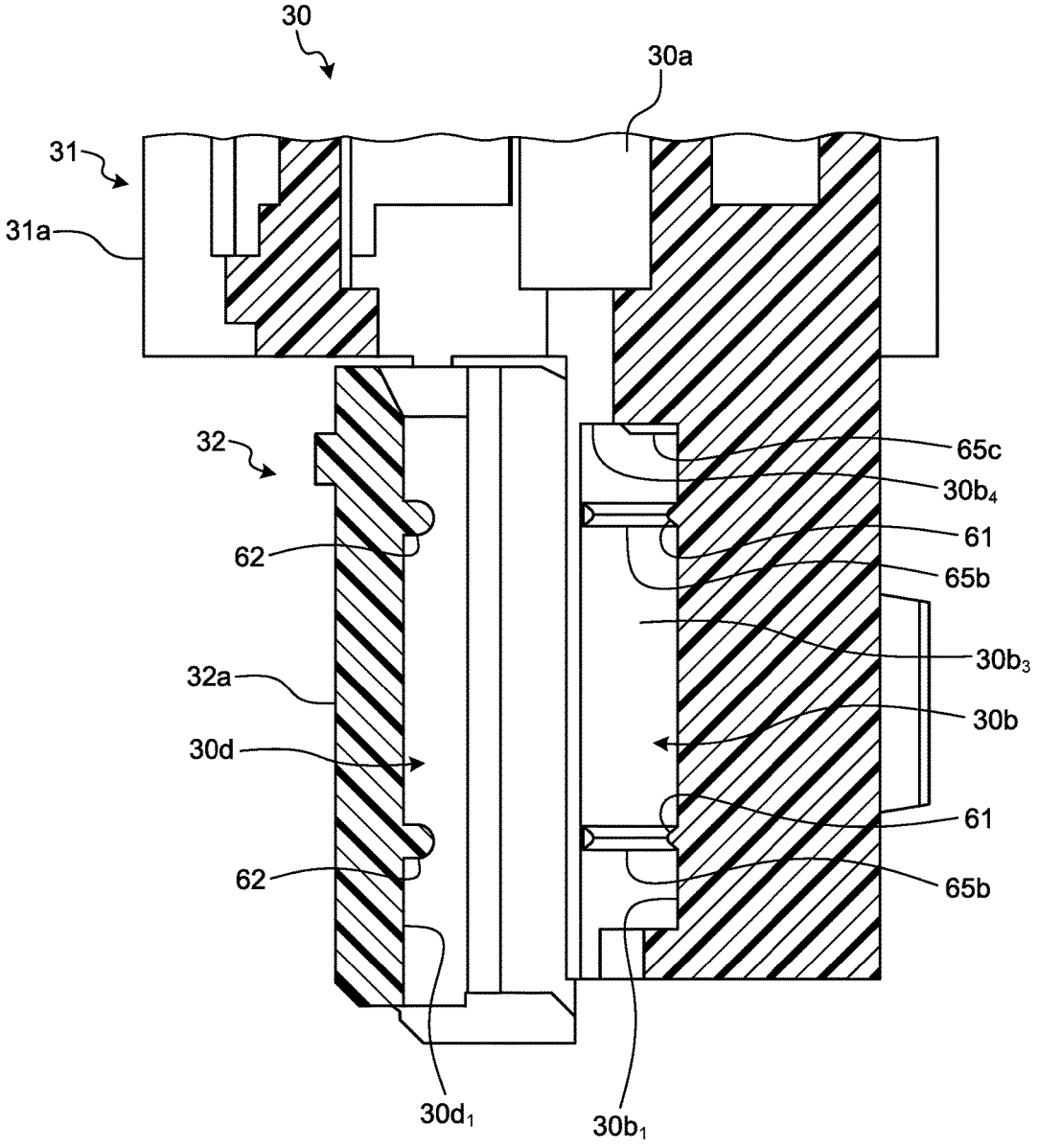
FIG. 12 is a cross-sectional view along line X-X in FIG. 8, and is an enlarged view illustrating the periphery of the first sensor housing chamber.

By contrast, the second pressing portion 62 may project toward the electric wire WH as the housed temperature detection target 40, and press and push the electric wire WH to the temperature sensor 50. In this case, at least one second pressing portion 62 is provided to each of the first electric wire housing chamber 30*d* and the second electric wire housing chamber 30*e*. The two second pressing portions 62 in this exemplified first electric wire housing chamber 30*d* are provided at intervals from each other in the axis direction of the housed first electric wire WH1 (FIG. 11). Each of the second pressing portions 62 projects from a wall surface 30$d_1$ of the first electric wire housing chamber 30*d* toward the first electric wire WH1. The two second pressing portions 62 in this exemplified second electric wire housing chamber 30*e* are provided at intervals from each other in the axis direction of the housed second electric wire WH2. Each of the second pressing portions 62 projects from a wall surface 30$e_1$ of the second electric wire housing chamber 30*e* toward the second electric wire WH2.

This exemplified holder 30 includes a first holder member 31 and a second holder member 32 that are engaged with each other (FIGS. 3 to 8), and engaging the first holder member 31 and the second holder member 32 with each other forms the first sensor housing chamber 30*b*, the second sensor housing chamber 30*c*, the first electric wire housing chamber 30*d*, and the second electric wire housing chamber 30*e*. In the holder 30, the first holder member 31 includes one of the first pressing portions 61 and the second pressing portions 62, and the second holder member 32 includes the other of the first pressing portions 61 and the second pressing portions 62. In the holder 30, engaging the second holder member 32 with the first holder member 31 generates pressing force of the first pressing portions 61 to the temperature sensors 50 (the first temperature sensor 50A and the second temperature sensor 50B) and pressing force of the second pressing portions 62 to the electric wires WH (the first electric wire WH1 and the second electric wire WH2) as the temperature detection targets 40.

In this example, five terminal housing chambers 30*a*, the first sensor housing chamber 30*b*, and the second sensor housing chamber 30*c* are formed in the first holder member 31, and the first electric wire housing chamber 30*d* and the second electric wire housing chamber 30*e* are formed in the second holder member 32. Thus, in this exemplified holder 30, the first pressing portions 61 are provided to the first holder member 31, and the second pressing portions 62 are provided to the second holder member 32.

In order to be engaged with the other aperture 21*b* (FIG. 3) in the main body 21 of the connector housing 20, the first holder member 31 has a main body 31*a* formed in a cylindrical shape (FIGS. 4 to 8). The first holder member 31 has, formed therein, the first to fourth wall surfaces $\mathbf{30}b_1$ to $\mathbf{30}b_4$ (FIG. 9) that form the first sensor housing chamber 30*b* and the first to fourth wall surfaces $\mathbf{30}c_1$ to $\mathbf{30}c_4$ (FIG. 10) that form the second sensor housing chamber 30*c*. The aperture 21*b* of the connector housing 20 is divided into a plurality of apertures, and certain apertures out of the divided apertures form the other aperture 23*b* in the terminal housing chamber 23.

In this exemplified connector 1, the plurality of electric wires WH (the first electric wire WH1 and the second electric wire WH2) are provided as the temperature detection target 40, and, for each electric wire WH, the temperature sensor 50 (the first temperature sensor 50A and the second temperature sensor 50B) is provided. This exemplified second holder member 32 is provided for each combination of the electric wire WH and the temperature sensor 50. In the embodiment, the second holder member 32 corresponding to a combination of the first electric wire WH1 and the first temperature sensor 50A and the second holder member 32 corresponding to a combination of the second electric wire WH2 and the second temperature sensor 50B are formed in the same shape. For example, each of the second holder members 32 includes an arc-shaped main body 32*a* (FIGS. 4 and 7). In one of the second holder members 32, the inner periphery of the main body 32*a* is the wall surface $\mathbf{30}d_1$ that forms the first electric wire housing chamber 30*d*. In the other second holder member 32, the inner periphery of the main body 32*a* is the wall surface $\mathbf{30}e_1$ that forms the second electric wire housing chamber 30*e*.

In the holder 30, after the first temperature sensor 50A is disposed in the first sensor housing chamber 30*b*, the first terminal 10A is inserted from an aperture $\mathbf{31}a_1$ (FIG. 8) provided to an outer periphery of the main body 31*a* of the first holder member 31 into the terminal housing chamber 30*a*. The first electric wire WH1 has been already attached to the first terminal 10A together with the first protection member 15A, and is disposed along the first temperature sensor 50A following insertion of the first terminal 10A. In the holder 30, the second holder member 32 is engaged with the first holder member 31 while being disposed in the first electric wire housing chamber 30*d* in order not to bite the first electric wire WH1, and the first temperature sensor 50A and the first electric wire WH1 are closely attached to each other at the completion of the engagement. Similarly, in the holder 30, after the second temperature sensor 50B is disposed in the second sensor housing chamber 30*c*, the second terminal 10B is inserted from an aperture $\mathbf{31}a_2$ (FIG. 8) provided to the outer periphery of the main body 31*a* of the first holder member 31 into the terminal housing chamber 30*a*. In the holder 30, the second holder member 32 is engaged with the first holder member 31 while being disposed in the second electric wire housing chamber 30*e* in order not to bite the second electric wire WH2, and the second temperature sensor 50B and the second electric wire WH2 are closely attached to each other at the completion of the engagement.

The holder 30 includes a holding structure 80 between the first holder member 31 and the second holder member 32, the holding structure 80 holding the first holder member 31 and the second holder member 32 engaged with each other in the engagement state (FIGS. 4 to 8). Between the first holder member 31 and one of the second holder members 32, the holding structure 80 is provided at least at two positions (FIG. 8). For example, this exemplified holding structure 80 includes a first engagement holding portion 81 that is provided to the first holder member 31, a second engagement holding portion 82 that is provided to the second holder member 32 and is engaged with the first engagement holding portion 81 so as to keep the engagement state of the first holder member 31 and the second holder member 32, and a flexible portion 83 that includes one of the first engagement holding portion 81 and the second engagement holding portion 82, and has flexibility of deflecting during engagement operation of the first holder member 31 and the second holder member 32 and eliminating deflection at the completion of engagement between the first holder member 31 and the second holder member 32.

When the first engagement holding portion 81 in each of the holding structures 80 sandwiches the second engagement holding portion 82 in the holding structure 80, the flexible portion 83 in the holding structure 80 is provided to the second holder member 32 and includes the second engagement holding portion 82. In this case, when the first holder member 31 and the second holder member 32 are being engaged with each other, each of the flexible portions 83 is disposed inside the corresponding first engagement holding portion 81, and is locked with the first engagement holding portion 81. In this case, in the engagement state, the first sensor housing chamber 30*b*, the second sensor housing chamber 30*c*, the first electric wire housing chamber 30*d*, and the second electric wire housing chamber 30*e* are disposed inside each of the flexible portions 83. Even when each of the flexible portions 83 receives some force from the temperature sensor 50 and the electric wire WH, the flexible portion 83 is locked with the first engagement holding portion 81 so as to keep an engagement state between the first engagement holding portion 81 and the second engagement holding portion 82.

By contrast, When the second engagement holding portion 82 in each of the holding structures 80 sandwiches the first engagement holding portion 81 in the corresponding holding structure 80, the flexible portion 83 in the holding structure 80 is provided to the first holder member 31 and includes the first engagement holding portion 81. In this case, when the first holder member 31 and the second holder member 32 are being engaged with each other, each of the flexible portions 83 is disposed inside the corresponding second engagement holding portion 82, and is locked with the second engagement holding portion 82. In this case, while in the engagement state, the first sensor housing chamber 30*b*, the second sensor housing chamber 30*c*, the first electric wire housing chamber 30*d*, and the second electric wire housing chamber 30*e* are disposed inside each of the flexible portions 83. Even when each of the flexible portions 83 receives some force from the temperature sensor 50 and the electric wire WH, the flexible portion 83 is locked with the second engagement holding portion 82 so as to keep an engagement state between the first engagement holding portion 81 and the second engagement holding portion 82.

Specifically, this exemplified holding structure 80 represents the former one (FIGS. 7 and 8) out of the examples, and has the first engagement holding portion 81 provided to the first holder member 31 and has the second engagement holding portion 82 and the flexible portion 83 provided to the second holder member 32. This exemplified first engagement holding portion 81 is a piece portion that is provided to the main body 31*a* of the first holder member 31, and forms a through-hole 84 with a planar wall surface 31$b_1$ in the main body 31*a* (FIG. 7). In the first holder member 31, two first engagement holding portions 81 are provided for each second holder member 32 (FIG. 8). By contrast, in the second holder member 32, two piece portions project from an end part of the main body 32*a* in a circumferential direction toward the same direction, and each of the piece portions is used as the flexible portion 83. Each of the piece portions (flexible portions 83) is disposed at intervals from each other in the deflection direction. In the second holder member 32, a claw projecting portion is formed at an end part of each of the piece portions (flexible portions 83) on a projection direction, and each of the projecting portions is used as the second engagement holding portion 82. The second engagement holding portions 82 and the flexible portions 83 are inserted into the through-holes 84 of the first holder member 31 at the engagement of the second holder member 32 with the first holder member 31. The second engagement holding portions 82 are hooked on the first engagement holding portions 81 after completion of the engagement. The second engagement holding portions 82 deflect the flexible portions 83 while pushed in the first engagement holding portions 81 during engagement operation of the first holder member 31 and the second holder member 32. After the engagement, the second engagement holding portions 82 get over the first engagement holding portions 81 and eliminate deflection of the flexible portions 83. In the holding structure 80, as the deflection is eliminated, the second engagement holding portions 82 are hooked on the first engagement holding portions 81, an the first holder member 31 and the second holder member 32 are kept engaged with each other.

The holding structure 80 can keep the engagement state as described above so as to keep a state where the temperature sensors 50 and the electric wires WH are closely attached to each other. Thus, in the connector 1, each of the temperature sensors 50 (the first temperature sensor 50A and the second temperature sensor 50B) can further improve accuracy in temperature detection of the corresponding electric wire WH (the first electric wire WH1 and the second electric wire WH2).

As described above, the connector 1 according to the embodiment contributes to improvement of accuracy in temperature detection of the electric wires WH (the first electric wire WH1 and the second electric wire WH2) using the temperature sensors 50 (the first temperature sensor 50A and the second temperature sensor 50B).

In the connector according to the present embodiment, a first pressing portion is formed as a projecting portion that projects toward a temperature sensor, and can form an air layer between the temperature sensor and a wall surface of a sensor housing chamber of the temperature sensor. Thus, in the sensor housing chamber, the temperature sensor is not brought into contact with the wall surface, and a contact area of the temperature sensor with the wall surface of the sensor housing chamber becomes small, thereby reducing a heat transfer amount for heat of the temperature sensor to the wall surface. Thus, the connector can improve accuracy in temperature detection of an electric wire using the temperature sensor.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal;

a connector housing that houses the terminal;

a temperature sensor that detects temperature of a temperature detection target, the temperature detection target being the terminal or an electric wire connected to the terminal; and a holder that houses and holds the terminal, the electric wire, and the temperature sensor, wherein the holder includes at least one first pressing portion that projects toward the housed temperature sensor, and presses and pushes the temperature sensor to the temperature detection target, a second pressing portion that presses and pushes the housed temperature detection target to the temperature sensor, and a pair of projecting portions that projects toward the housed temperature sensor and sandwiches the housed temperature sensor in a first direction, the first direction intersects with a second direction in which the first pressing portion presses the temperature sensor, and the first direction is along a direction orthogonal to an axis direction of the housed electric wire, and the first pressing portion and the pair of projecting portions abut the housed temperature sensor and form an air layer between the housed temperature sensor and a wall surface of the holder.

2. The connector according to claim 1, wherein the first pressing portion is formed so as to be brought into point-contact or line-contact with the temperature sensor.

3. The connector according to claim 1, wherein at least the one first pressing portion is disposed so as to press and push a temperature detecting portion of the temperature sensor to the temperature detection target.

4. The connector according to claim 2, wherein at least the one first pressing portion is disposed so as to press and push a temperature detecting portion of the temperature sensor to the temperature detection target.

5. The connector according to claim 1, wherein the holder includes a first holder member that includes one of the first pressing portion and the second pressing portion, and a second holder member that includes the other of the first pressing portion and the second pressing portion, and is engaged with the first holder member so as to generate pressing force of the first pressing portion to the temperature sensor and pressing force of the second pressing portion to the temperature detection target.

6. The connector according to claim 2, wherein the holder includes a first holder member that includes one of the first pressing portion and the second pressing portion, and a second holder member that includes the other of the first pressing portion and the second pressing portion, and is engaged with the first holder member so as to generate pressing force of the first pressing portion to the temperature sensor and pressing force of the second pressing portion to the temperature detection target.

7. The connector according to claim 3, wherein the holder includes a first holder member that includes one of the first pressing portion and the second pressing portion, and a second holder member that includes the other of the first pressing portion and the second pressing portion, and is engaged with the first holder member so as to generate pressing force of the first pressing portion to the temperature sensor and pressing force of the second pressing portion to the temperature detection target.

8. The connector according to claim 4, wherein the holder includes a first holder member that includes one of the first pressing portion and the second pressing portion, and a second holder member that includes the other of the first pressing portion and the second pressing portion, and is engaged with the first holder member so as to generate pressing force of the first pressing portion to the temperature sensor and pressing force of the second pressing portion to the temperature detection target.

9. The connector according to claim 5, wherein the holder includes a holding structure at least at two positions, the holding structures holding the first holder member and the second holder member engaged with each other in an engagement state, each of the holding structures includes a first engagement holding portion that is provided to the first holder member, a second engagement holding portion that is provided to the second holder member and is engaged with the first engagement holding portion so as to keep the engagement state, and a flexible portion that includes one of the first engagement holding portion and the second engagement holding portion, and has flexibility of deflecting during engagement operation of the first holder member and the second holder member and eliminating deflection at completion of engagement between the first holder member and the second holder member, and the flexible portion in each of the holding structures is, when the first engagement holding portion in the holding structure sandwiches the second engagement holding portion in the holding structure, provided to the second holder member and includes the second engagement holding portion, and is, when the second engagement holding portion in the holding structure sandwiches the first engagement holding portion in the holding structure, provided to the first holder member and includes the first engagement holding portion.

10. The connector according to claim 6, wherein the holder includes a holding structure at least at two positions, the holding structures holding the first holder member and the second holder member engaged with each other in an engagement state, each of the holding structures includes a first engagement holding portion that is provided to the first holder member, a second engagement holding portion that is provided to the second holder member and is engaged with the first engagement holding portion so as to keep the engagement state, and a flexible portion that includes one of the first engagement holding portion and the second engagement holding portion, and has flexibility of deflecting during engagement operation of the first holder member and the second holder member and eliminating deflection at completion of engagement between the first holder member and the second holder member, and the flexible portion in each of the holding structures is, when the first engagement holding portion in the holding structure sandwiches the second engagement holding portion in the holding structure, provided to the second holder member and includes the second engagement holding portion, and is, when the second engagement holding portion in the holding structure sandwiches the first engagement holding portion in the holding structure, provided to the first holder member and includes the first engagement holding portion.

11. The connector according to claim 7, wherein the holder includes a holding structure at least at two positions, the holding structures holding the first holder member and the second holder member engaged with each other in an engagement state, each of the holding structures includes a first engagement holding portion that is provided to the first holder member, a second engagement holding portion that is provided to the second holder member and is engaged with the first engagement holding portion so as to keep the engagement state, and a flexible portion that includes one of the first engagement holding portion and the second engagement holding portion, and has flexibility of deflecting during engagement operation of the first holder member and the second holder member and eliminating deflection at completion of engagement between the first holder member and the second holder member, and the flexible portion in each of the holding structures is, when the first engagement holding portion in the holding structure sandwiches the second engagement holding portion in the holding structure, provided to the second holder member and includes the second engagement holding portion, and is, when the second engagement holding portion in the holding structure sandwiches the first engagement holding portion in the holding structure, provided to the first holder member and includes the first engagement holding portion.

12. The connector according to claim 8, wherein the holder includes a holding structure at least at two positions, the holding structures holding the first holder member and the second holder member engaged with each other in an engagement state, each of the holding structures includes a first engagement holding portion that is provided to the first holder member, a second engagement holding portion that is provided to the second holder member and is engaged with the first engagement holding portion so as to keep the engagement state, and a flexible portion that includes one of the first engagement holding portion and the second engagement holding portion, and has flexibility of deflecting during engagement operation of the first holder member and the second holder member and eliminating deflection at completion of engagement between the first holder member and the second holder member, and the flexible portion in each of the holding structures is, when the first engagement holding portion in the holding structure sandwiches the second engagement holding portion in the holding structure, provided to the second holder member and includes the second engagement holding portion, and is, when the second engagement holding portion in the holding structure sandwiches the first engagement holding portion in the holding structure, provided to the first holder member and includes the first engagement holding portion.

13. The connector according to claim 5, wherein when a plurality of the temperature detection targets are provided and the temperature sensor is provided for each of the temperature detection targets, the second holder member is provided for each combination of the temperature detection target and the temperature sensor.

14. The connector according to claim 9, wherein when a plurality of the temperature detection targets are provided and the temperature sensor is provided for each of the temperature detection targets, the second holder member is provided for each combination of the temperature detection target and the temperature sensor.

15. The connector according to claim 1, wherein the temperature detection target is the electric wire.

16. The connector according to claim 2, wherein the temperature detection target is the electric wire.

17. The connector according to claim 3, wherein the temperature detection target is the electric wire.

18. The connector according to claim 5, wherein the temperature detection target is the electric wire.

19. The connector according to claim 9, wherein the temperature detection target is the electric wire.

20. The connector according to claim 13, wherein the temperature detection target is the electric wire.

* * * * *